US005102149A

United States Patent [19]

Gascoigne

[11] Patent Number: 5,102,149

[45] Date of Patent: Apr. 7, 1992

[54] MANUALLY OPERABLE GAME SET

[76] Inventor: Guy Gascoigne, 684 N. James Street, Thunder Bay, Ontario, Canada, P7C 5M6

[21] Appl. No.: 567,353

[22] Filed: Aug. 14, 1990

[30] Foreign Application Priority Data

Aug. 15, 1989 [CA] Canada ..... 608445

[51] Int. Cl.[5] ..... A63F 9/06

[52] U.S. Cl. ..... 273/459; 273/282

[58] Field of Search ..... 273/1 G, 1 GC, 1 GD, 273/153 S, 282

[56] References Cited

U.S. PATENT DOCUMENTS

| | | | |
|---|---|---|---|
| 859,692 | 7/1907 | Robbins | 273/282 B X |
| 2,207,190 | 7/1940 | Carnahan | 273/1 G |
| 3,693,976 | 9/1972 | Flack | 273/282 C X |
| 3,792,866 | 2/1974 | Dreyer et al. | 273/282 R X |
| 4,032,144 | 6/1977 | Moustakas | 273/1 G X |
| 4,765,748 | 8/1988 | Fioalso | 273/1 G |
| 4,844,473 | 7/1989 | Landsberg | 273/282 R X |
| 4,898,383 | 2/1990 | Buffington | 273/1 G |

*Primary Examiner*—Paul E. Shapiro
*Attorney, Agent, or Firm*—Smart & Biggar

[57] ABSTRACT

A mechanical game set has game pieces (12) with offset ends (30, 32) that may be cooperatively maneuvered, by pivotal or rotational movement, along a frame (10) by removing or inserting balls (42, 43) into sockets 26 one posts (16, 18, 20) of the frame.

1 Claim, 3 Drawing Sheets

MANUALLY OPERABLE GAME SET

FIELD OF THE INVENTION

This invention relates to a manually operable game set, and more particularly, to a manually operable game set in which game pieces can be pivotally and rotatably moved along a three-dimensional frame.

BACKGROUND OF THE INVENTION

Educational toys and games are known in which a central structural frame is constructed by the use of coupling elements and rods. Such a toy is shown in U.S. Pat. No. 3,747,261, issued July 24, 1973, in the name of Salem, in which a ball and rod linkage is sued for joining polyhedral members.

Such educational toys and the like, however, do not permit the cooperative movement of game pieces around a central structural frame. Rather, such known educational toys are generally static in nature.

SUMMARY OF THE INVENTION

It is an object of the present invention to provide an improved manually operable three-dimensional game set.

It is a further object of the present invention to provide a mechanical game set with game pieces that may be cooperatively maneuvered, by pivotal or rotational movement, along a central frame by the removable insertion of the game pieces into the frame.

According to one broad aspect of this invention, there is provided a ladder game set comprising ladder means having first, second and third uniformly spaced co-extensive rows of uniformly spaced sockets which are arranged in spaced parallel planes, and movable cross-bar members having a sufficient length to bridge the space between adjacent rows of sockets, said cross-bar members having first and second plug means at opposite ends thereof, each adapted to seat releasably within one of said sockets. The first plug means are laterally offset with respect to the second plug means such that the first plug means may be seated in a socket of said first row which is located in a first of said planes when the second plug means is seated in a socket of the second row which is located in a second of said planes, said cross-bar member being pivotable about each end to permit the first plug to be unseated from a socket of the first plane while the second plug remains seated in a socket of the second plane, the cross-bar member also being rotatable to then permit the first plug to be unseated from said socket in the first plane and rotated upon the second plug to allow the first plane and rotated upon the second plug to allow the first plug to be seated in a socket which is located in a third plane which is adjacent to the second plane and remote from the first plane such that, by manipulating the cross-bar member to alternately seat and unseat the first and second plugs, the cross-bar member may be maneuvered up, down and around the ladder means.

BRIEF DESCRIPTION OF DRAWINGS

An example embodiment of the invention is shown in the accompanying drawings, in which.

DESCRIPTION OF PREFERRED EMBODIMENT

Figure 1:
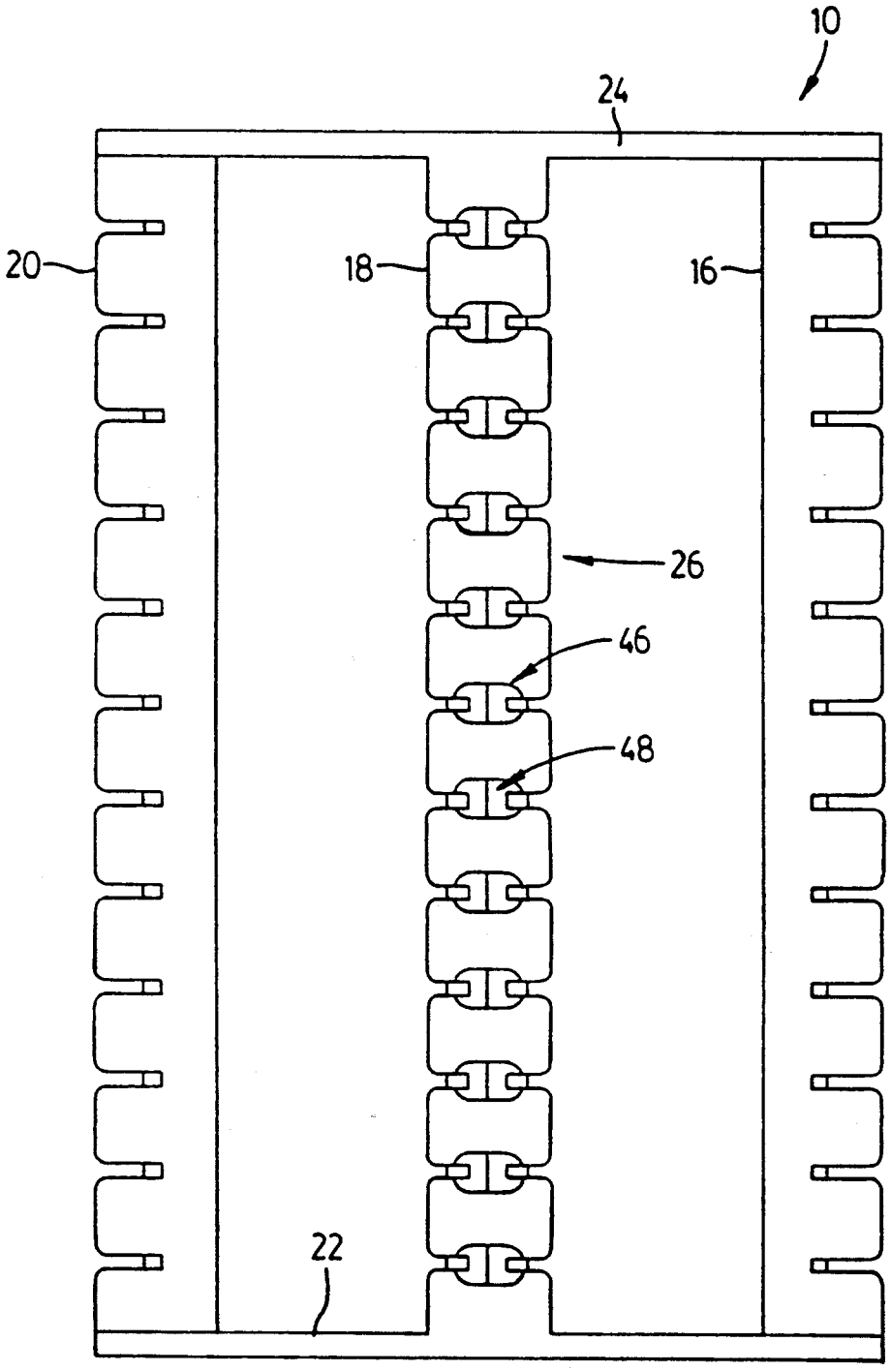
FIG. 1 is a side view of the game structure or ladder means of the present invention.
Figure 2:
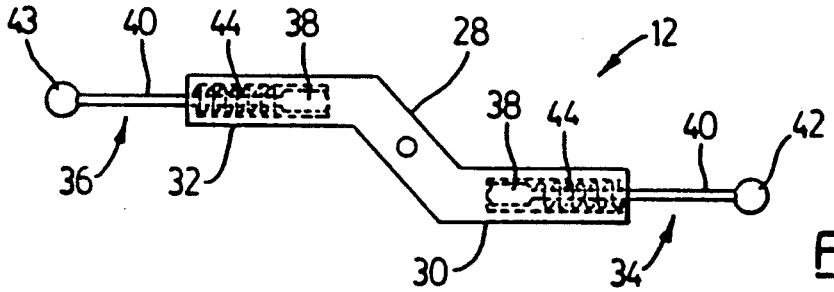
FIG. 2 is a side view, in partial section, of a game piece or cross-bar member of the present invention.
Figure 3:
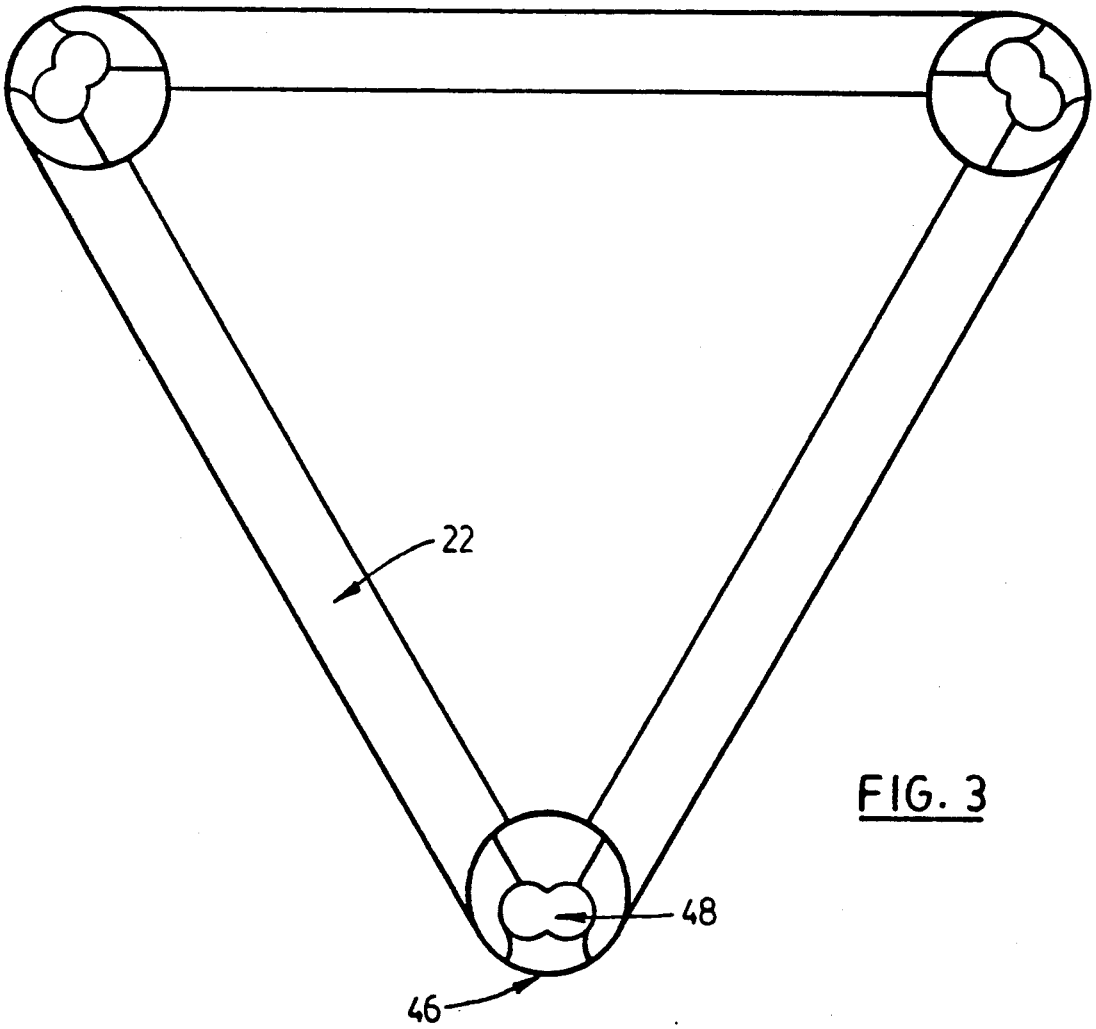
FIG. 3 is a top plan view, in partial section, of the ladder means shown in FIG. 1.
Figure 4:
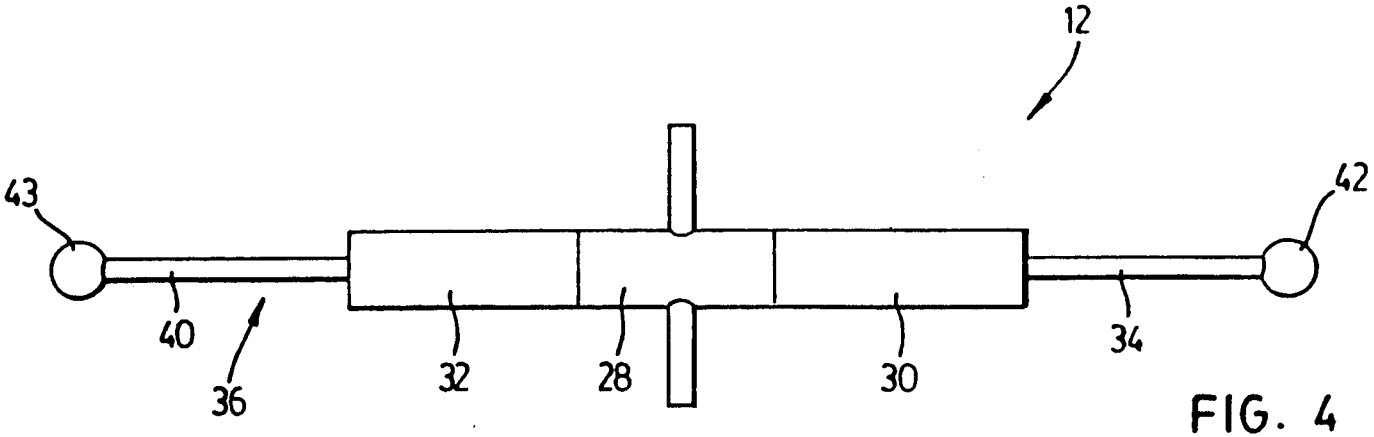
FIG. 4 is a top plan view of the cross-bar member shown in FIG. 2.

With reference to the drawings, there is shown a ladder means 10, cross-bar member 12 and a clip-obstacle 14. The ladder means 10 is of a fixed configuration, and has three symmetrically spaced parallel posts 16, 18 and 20 each of which are connected at their respective ends to a bottom rail 22 and a top rail 24. Positioned along the length of posts 16, 18 and 20 are co-extensive rows of uniformly spaced coupling sockets 26, which are arranged in spaced parallel planes.

Cross-bar member 12 has a central body 28 with laterally offset tubular housings 30 and 32, at opposite ends thereof. Extending outwardly from tubular housings 30 and 32 are movable coupling members 34 and 35, respectively. Coupling members 34 and 36 each have a base 38 that is positioned within the respective tubular housing, a shaft 40 that extends outwardly from base 38, and ball-shaped plug means 42 at the end of each shaft 40. A spring 44 is positioned around each shaft 40, within the respective tubular housings, to provide resistance to the outward movement or expansion of each movable coupling member.

Each coupling socket 26 has a port 46 having a dimension and size that permits plug means 42 to be removably seated within the coupling socket. Additionally, each coupling socket has a central cavity 48 that is generally capsule-shaped. This shape of the cavity permits the ball-shaped plug means 42, when removably seated therein, to either be fully rotated or pivoted.

Figure 5:
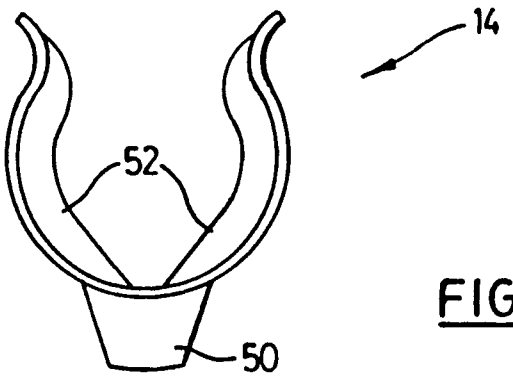
FIG. 5 is a top plan view of a clip-obstacle of the present invention.

As shown in FIG. 5, clip-obstacle 14 has an external handle 50 that permits easy manipulation and grasping thereof. Obstacle 14 also has an internal coupling 52 that cooperates with port 46 of coupling socket 26, to permit removable insertion of obstacle 14 into coupling socket 26. It will be appreciated that obstacle 14 may be made of a resilient material such as plastic, in order to permit the snap-fit of obstacle 14 within port 46.

In the operation of the game set shown in the drawings, cross-bar member 12 can be releasably seated within ladder means 10, by the insertion of first plug means 42 within a coupling socket on post 16. Once first plug means 42 is thereby releasably seated within a coupling socket on post 16, second plug means 43 at the opposite end of cross-bar member 12 can be releasably seated within a coupling socket located on a horizontally adjacent plane, on vertically adjacent post 18. To achieve this movement, the body 28 of the cross-bar member 12 is pulled away from post 16, in the direction towards post 18, thereby expanding the length of movable coupling member 34. Once expanded, second plug means 43 may be releasably seated within the appropriate horizontally adjacent coupling socket 26 on post 18. Once this movement is complete, pressure may be removed from the cross-bar means to permit springs 44 to thereby contract, so as to releasably hold the first plug means 42 and second plug means 43 in secure position within the coupling sockets on posts 16 and 18, respectively.

Cross-bar member 12 can also be manually maneuvered to ascend or descend ladder means 10. For example, to ascend ladder means 10, first plug means 42, which was originally seated in a coupling socket of a horizontally adjacent plane lower than the coupling socket in which second plug means 43 is seated, may be rotated so that it is releasably seated in a third plane of coupling sockets, which is horizontally adjacent to the plane of the coupling socket within which the second plug means 43 is seated, but is remote from the plane of a coupling socket in which the first plug means has formerly seated. This movement is achieved by first removing the first plug means 42 from its coupling socket, by pulling movable coupling member 34 in the direction away from movable coupling member 38, so as to expand the length of cross-bar member 12. Once the cross-bar member is expanded, first plug means 42 is removed from the coupling socket 26. The entire cross-bar member is then rotated 180 degrees as second plug means 43 is spun while being releasably seated within its coupling socket. As a result, first plug means 42 is thereby rotated from a coupling socket of an horizontally adjacent plane lower than the coupling within which the second plug means is releasably seated to a coupling socket of an horizontally adjacent plane above that within which the second plug means 43 is releasably seated. It will be appreciated that this entire movement may be reversed in order to permit cross-bar member 12 to descent ladder means 10.

Cross-bar member 12 may also be pivoted to permit it to be re-positioned between adjacent posts. For example, while first plug means 43 of cross-bar member 12 is releasably seated within its coupling socket on post 16, oppositely disposed second plug means 43 may be released from its coupling socket on post 18, in the manner described above. First plug means 38, which remains releasably seated within its coupling socket, may then be pivoted within the cavity of its coupling socket, so that second plug means 43 may then be releasably seated within a coupling socket on post 20.

It will be appreciated that cross-bar member 12 may also be pivoted and rotated simultaneously. Additionally, movement of cross-bar member 12 along ladder means 10 may be hindered by use of clip-obstacle 14 which, when inserted into a coupling socket, prevents the insertion of plug means 42 and 43 into the obstructed coupling socket.

It will also be appreciated that the actual numbers of posts that comprise ladder means 10 may vary, as long as the shape provided by the number of posts is symmetrical (i.e. the use of four posts would form a square, five posts would form a pentagon, and so on). It will also be appreciated that the number of sockets positioned on each post may vary, provided that each post has the same number of sockets.

The construction of the cross-bar member may also be modified by re-locating springs 44 so that they are positioned at the ends of housings 30 and 32, remote from plug means 42 and 43. By relocation of the springs in this manner, it will be appreciated that movement of cross-bar member 12 along ladder means 10 is achieved by the compression of the movable coupling members towards each other, rather than by expansion, as described above.

I claim:

1. A ladder game set comprising:

(a) ladder means having first, second and third uniformly spaced co-extensive rows of uniformly spaced sockets which are arranged in spaced parallel planes; and, (b) at least one movable cross-bar member having a sufficient length to bridge the space between adjacent rows of sockets, said cross-bar member having first and second plug means at opposite ends thereof adapted to seat releasably within one of said sockets, said first plug means being laterally offset with respect to the second plug means such that the first plug means may be seated in a socket on said first row which is located in the first of said planes while the second plug means is seated in a socket of the second row which is located in a second of said planes, said cross-bar member being pivotable about each end to permit the first plug means to be unseated from a socket of the first row while the second plug means remains seated in a socket of the second row, the cross-bar means also being rotatable to permit the first plug to be unseated from the socket in the first plane and rotated upon the second plug to allow the first plug means to be seated in a socket which is located in a third plane which is adjacent to the second plane and remote from the first plane such that, by manipulating the cross-bar member to alternately seat and unseat the first and second plugs, the cross-bar member may be maneuvered up and down the ladder means.

* * * * *